US010738995B2

(12) United States Patent
Ono

(10) Patent No.: US 10,738,995 B2
(45) Date of Patent: Aug. 11, 2020

(54) BURNER

(71) Applicant: RINNAI CORPORATION, Aichi (JP)

(72) Inventor: Takahiro Ono, Nagoya (JP)

(73) Assignee: RINNAI CORPORATION, Aichi (JP)

( * ) Notice: Subject to any disclaimer, the term of this patent is extended or adjusted under 35 U.S.C. 154(b) by 274 days.

(21) Appl. No.: 16/038,703

(22) Filed: Jul. 18, 2018

(65) Prior Publication Data

US 2019/0032915 A1 Jan. 31, 2019

(30) Foreign Application Priority Data

Jul. 31, 2017 (JP) ..... 2017-148204

(51) Int. Cl.

| | |
|---|---|
| ***F23D 14/14*** | (2006.01) |
| ***F23D 14/46*** | (2006.01) |
| ***F23D 14/36*** | (2006.01) |
| ***F23D 14/02*** | (2006.01) |

(52) U.S. Cl.

CPC ..... *F23D 14/14* (2013.01); *F23D 14/02* (2013.01); *F23D 14/145* (2013.01); *F23D 14/36* (2013.01); *F23D 14/46* (2013.01); *F23D 2203/102* (2013.01); *F23D 2208/10* (2013.01); *F23D 2212/201* (2013.01); *F23D 2900/00019* (2013.01); *F23D 2900/14001* (2013.01)

(58) Field of Classification Search

CPC ..... F23D 14/92; F23D 14/14; F23D 14/64; F23D 14/58

See application file for complete search history.

(56) References Cited

U.S. PATENT DOCUMENTS

| | | | | |
|---|---|---|---|---|
| 4,504,218 A * | 3/1985 | Mihara | F23D 14/14 431/326 |
| 5,360,490 A * | 11/1994 | Nelson | F23D 14/12 136/253 |
| 10,281,173 B2 * | 5/2019 | Naitoh | F24H 9/2035 |
| 10,512,776 B2 * | 12/2019 | Cho | A61H 23/0218 |
| 10,527,279 B2 * | 1/2020 | Ojiro | F24H 1/124 |

(Continued)

FOREIGN PATENT DOCUMENTS

| | | | |
|---|---|---|---|
| JP | 08136013 A * | 5/1996 | F23D 14/02 |
| JP | 2001235117 A * | 8/2001 | F23D 14/14 |
| JP | 2014-009839 A | 1/2014 | |

*Primary Examiner* — Edelmira Bosques
*Assistant Examiner* — Nikhil P Mashruwala
(74) *Attorney, Agent, or Firm* — Cermak Nakajima & McGowan LLP; Tomoko Nakajima

(57) ABSTRACT

A burner has: a combustion plate part through which air-fuel mixture is ejected; and a flame rod which lies opposite to a portion of the combustion plate part. The combustion plate part is constituted by: a burner frame in a shape of a picture frame; a metal-fiber knit which covers an opening enclosed by the burner frame; and a distribution plate which has formed therein a multiplicity of distribution holes and which sandwiches the metal-fiber knit between the burner frame and the distribution plate so that the air-fuel mixture is ejected from the opening through the distribution holes and the metal-fiber knit. Flame holes for ejecting the air-fuel mixture are formed in a portion of the burner frame, and the flame rod is disposed so as to lie opposite to that portion of the burner frame which has formed therein the flame holes.

4 Claims, 6 Drawing Sheets

(56) References Cited

U.S. PATENT DOCUMENTS

| | | | | |
|---|---|---|---|---|
| 2008/0145806 | A1* | 6/2008 | Ojiro | F23D 14/36<br>431/181 |
| 2009/0226854 | A1* | 9/2009 | Ojiro | F23D 14/78<br>431/351 |
| 2010/0294214 | A1* | 11/2010 | Lee | F23D 14/583<br>122/17.1 |
| 2010/0316967 | A1* | 12/2010 | Scribano | F23D 14/14<br>431/329 |
| 2018/0209640 | A1* | 7/2018 | Asai | F23D 14/045 |
| 2019/0024941 | A1* | 1/2019 | Ono | F23D 14/145 |
| 2019/0032916 | A1* | 1/2019 | Takeuchi | F23D 14/145 |
| 2019/0186785 | A1* | 6/2019 | Ono | F23D 14/14 |

* cited by examiner

BURNER

TECHNICAL FIELD

The present invention relates to a burner comprising: a combustion plate part through which air-fuel mixture is ejected; and a flame rod which lies opposite to a portion of the combustion plate part.

BACKGROUND ART

In this kind of burner, there is conventionally known one in which a combustion plate part is constituted by: a burner frame in the shape of a picture frame; a metal-fiber knit (i.e., a metal knit formed of a heat resistant metal fiber) which is disposed to cover an opening enclosed by the burner frame; and a distribution plate which has formed therein a multiplicity of distribution holes and which sandwiches the metal-fiber knit between the burner frame and the distribution plate. The air-fuel mixture is thus ejected through the distribution holes and the metal-fiber knit (see, for example, JP-A-2014-9839). The flame rod is disposed in a manner to lie opposite to a portion of the opening to be enclosed by the burner frame, i.e., to lie opposite to a portion of the metal-fiber knit.

When the flame rod is moved closer to the metal-fiber knit, frayed fibers of the metal-fiber knit may come into contact with the flame rod, thereby giving rise to wrong detection of the flame. Therefore, it has been made the practice to dispose the flame rod at a certain degree of distance to the metal-fiber knit. However, this practice has a problem in that, when the flame length has become considerably shorter in weak combustion, the flame ceases to contact the flame rod, thereby giving rise to a misjudgment that a misfiring has occurred.

SUMMARY

Technical Problem

In view of the above-mentioned point, this invention has a problem of providing a burner which is capable of placing the flame rod closer to the combustion plate part such that the flame detection accuracy can be improved.

Solution to Problem

In order to solve the above problem, this invention is a burner comprising: a combustion plate part through which air-fuel mixture is ejected; and a flame rod which lies opposite to a portion of the combustion plate part. The combustion plate part is constituted by: a burner frame in a shape of a picture frame; a metal-fiber knit which covers an opening enclosed by the burner frame; and a distribution plate which has formed therein a multiplicity of distribution holes and which sandwiches the metal-fiber knit between the burner frame and the distribution plate so that the air-fuel mixture is ejected from the opening through the distribution holes and the metal-fiber knit. Flame holes for ejecting the air-fuel mixture are formed in a portion of the burner frame, and the flame rod is disposed so as to lie opposite to that portion of the burner frame which has formed therein the flame holes.

According to this invention, that portion of the combustion plate part which lies opposite to the flame rod corresponds to the burner frame. Therefore, even if the flame rod is made considerably closer to the combustion plate part, frayed fibers of the metal-fiber knit will not be brought into contact with the flame rod. Such being the case, even if the flame length becomes shorter in weak combustion, the flame to be formed on the flame holes will come into contact with the flame rod. The detection accuracy of the flame can thus be improved.

Further, according to this invention, preferably the burner frame has partly formed therein a protruded part which protrudes into the opening, and the flame holes may be formed in the protruded part. In this case, the flame rod will be disposed so as to lie opposite to the protruded part.

The protruded part which protrudes into the opening will rise to a considerably elevated temperature. Therefore, preferably the protruded part is constituted by a separate part which is independent of, but which is attached to, the burner frame. According to this arrangement, instead of forming the entire burner frame of a material higher in heat resistivity, only the separate part that constitutes the protruded part may be formed of a material higher in heat resistivity. This arrangement can therefore contribute to reduction in cost.

Preferably, the flame rod is provided with: a main body portion lying opposite to that portion of the burner frame which has formed therein the flame holes; and an extension portion which extends from the main body portion inward of the opening, and the extension portion is further away from the combustion plate part than is the main body portion. According to this arrangement, even if the flame to be formed above the flame holes in the burner frame at the time of strong combustion is lifted out of contact with the main body portion of the flame rod, the flame to be formed on the metal-fiber knit inside the opening will be in contact with the extension portion of the flame rod. The flame detection accuracy can thus be secured. By the way, since the extension portion of the flame rod is relatively further away from the combustion plate part, i.e., the metal-fiber knit, there will be no possibility of the frayed fibers' coming into contact with the extension portion.

DESCRIPTION OF EMBODIMENTS

Figure 1:
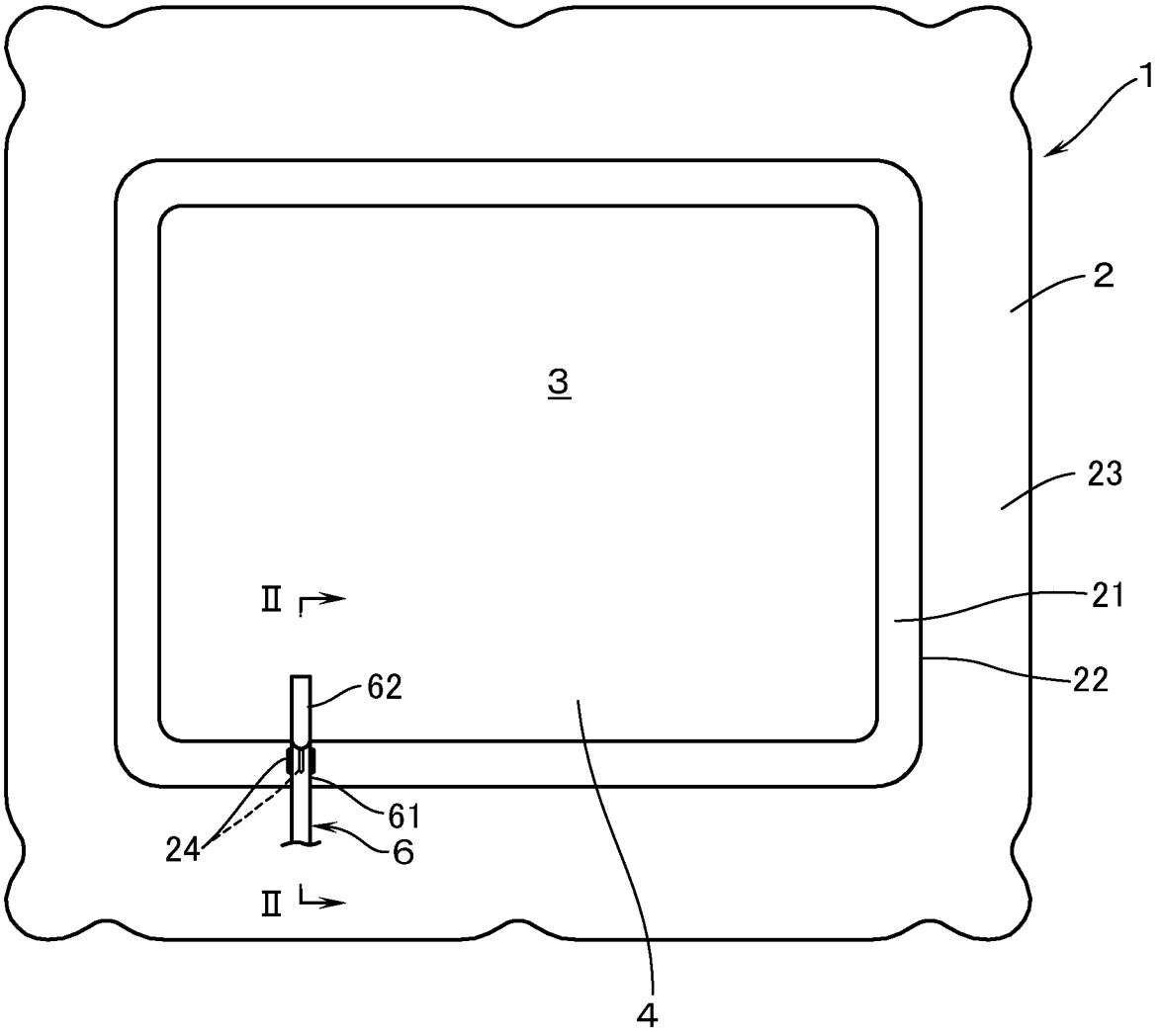
FIG. 1 is a plan view showing a combustion plate part of a burner according to a first embodiment of this invention.
Figure 2:
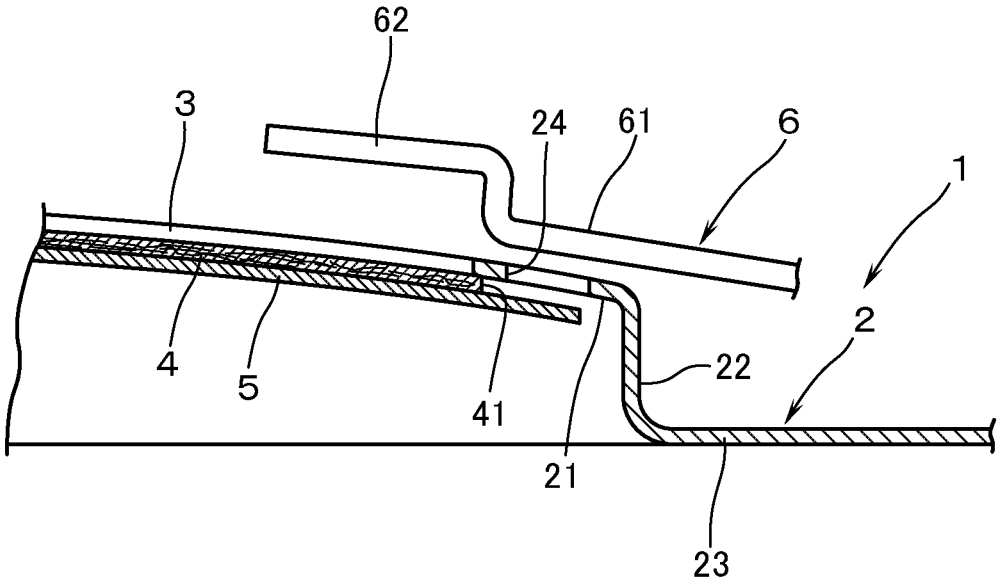
FIG. 2 is a sectional view cut along the line II-II in FIG. 1.
Figure 3:
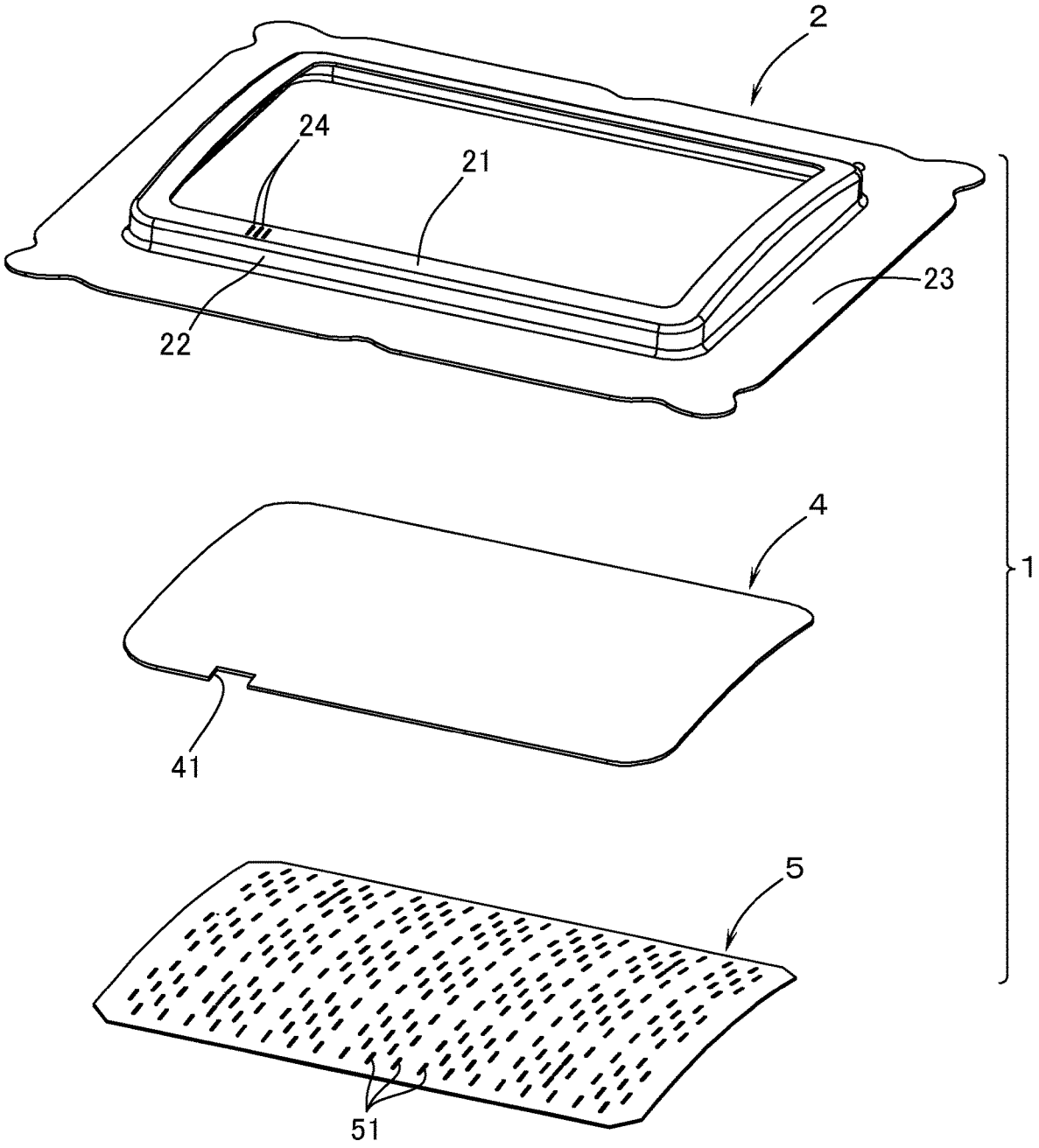
FIG. 3 is a perspective view in an exploded state of the combustion plate part in FIG. 1.

The burner according to an embodiment of this invention is provided with a combustion plate part 1 covering an upper surface of a box-shaped burner body which opens upward (not illustrated) for supplying thereto air-fuel mixture as shown in FIGS. 1 through 3. The combustion plate part 1 is constituted by: a burner frame 2 in the shape of a picture frame; a metal-fiber knit 4 which covers, from the lower side, an opening 3 enclosed by the burner frame 2; and a distribution plate 5 which has formed therein a multiplicity of slit-shaped distribution holes 51 and which sandwiches the metal-fiber knit 4 between the distribution plate 5 and the burner frame 2. Further, a flame rod 6 is disposed so as to lie opposite to a portion of the combustion plate part 1. By the way, the opening 3 is curved into an arcuate shape in cross section along the front-to-back direction (vertical direction in FIG. 1) and, similarly, the metal-fiber knit 4 and the distribution plate 5 are also respectively curved into an arcuate shape in cross section along the front-to-back direction.

The burner frame 2 has: an opening peripheral part 21 which is positioned on the same surface level as the opening 3; a side plate part 22 which is bent from the opening peripheral part 21 downward; and a flange part 23 which protrudes from a lower end of the side plate part 22 outward. The burner frame 2 is then fixed in position at its flange part 23 to a peripheral part of an upper surface of the burner body. Further, in a state in which the distribution plate 5 is placed under the metal-fiber knit 4, the peripheral parts of the metal-fiber knit 4 and the distribution plate 5 are spot welded for fixing to the opening peripheral part 21.

In a portion of the opening peripheral part 21 of the burner frame 2, there are formed flame holes 24 through which the air-fuel mixture is ejected. The flame rod 6 is disposed so as to lie opposite to that portion of the opening peripheral part 21 which has formed therein the flame holes 24. Further, in that portion of the metal-fiber knit 4 which overlaps that portion of the opening peripheral part 21 which has formed therein the flame holes 24, there is formed a notched part 41. Therefore, the air-fuel mixture is ejected out of the flame holes 24 without passing through the metal-fiber knit 4. Alternatively, by omitting the notched part 41, an arrangement may be made such that the air-fuel mixture is ejected out of the flame holes 24 through the metal-fiber knit 4.

In addition, in this embodiment, the flame rod 6 is provided with: a main body portion 61 which lies opposite to that portion of the burner frame 24 which has formed therein the flame holes 24; and an extension portion 62 which is extended from the main body portion 61 inward of the opening 3 so as to lie opposite to the metal-fiber knit 4. The extension portion 62 is further away from the combustion plate part 1 than is the main body portion 61 (than the main body portion 61 is away from the combustion plate 1).

According to the above-mentioned arrangement, that portion of the combustion plate 1 which lies opposite to the flame rod 6 is the burner frame 2. Therefore, even if the main body portion 61 is made considerably closer to the combustion plate part 1, the frayed fibers of the metal-fiber knit 4 will not come into contact with the main body portion 61. As a result, even in case the flame length becomes shorter in weak combustion, the flame to be formed on the flame holes 24 will come into contact with the main body portion 61, so that the flame detection accuracy can be improved.

In addition, even if the flame to be formed on the flame holes 24 is lifted at the time of strong combustion so that the flame ceases to be in contact with the main body portion 61 of the flame rod 6, the flame to be formed on the metal-fiber knit 4 inside the opening 3 comes into contact with the extension portion 62 of the flame rod 6. The flame detection accuracy can thus be secured. The extension portion 62 is relatively largely away from the combustion plate part 1, i.e., from the metal-fiber knit 4. Therefore, the frayed fibers will not come into contact with the extension portion 62.

Figure 4:
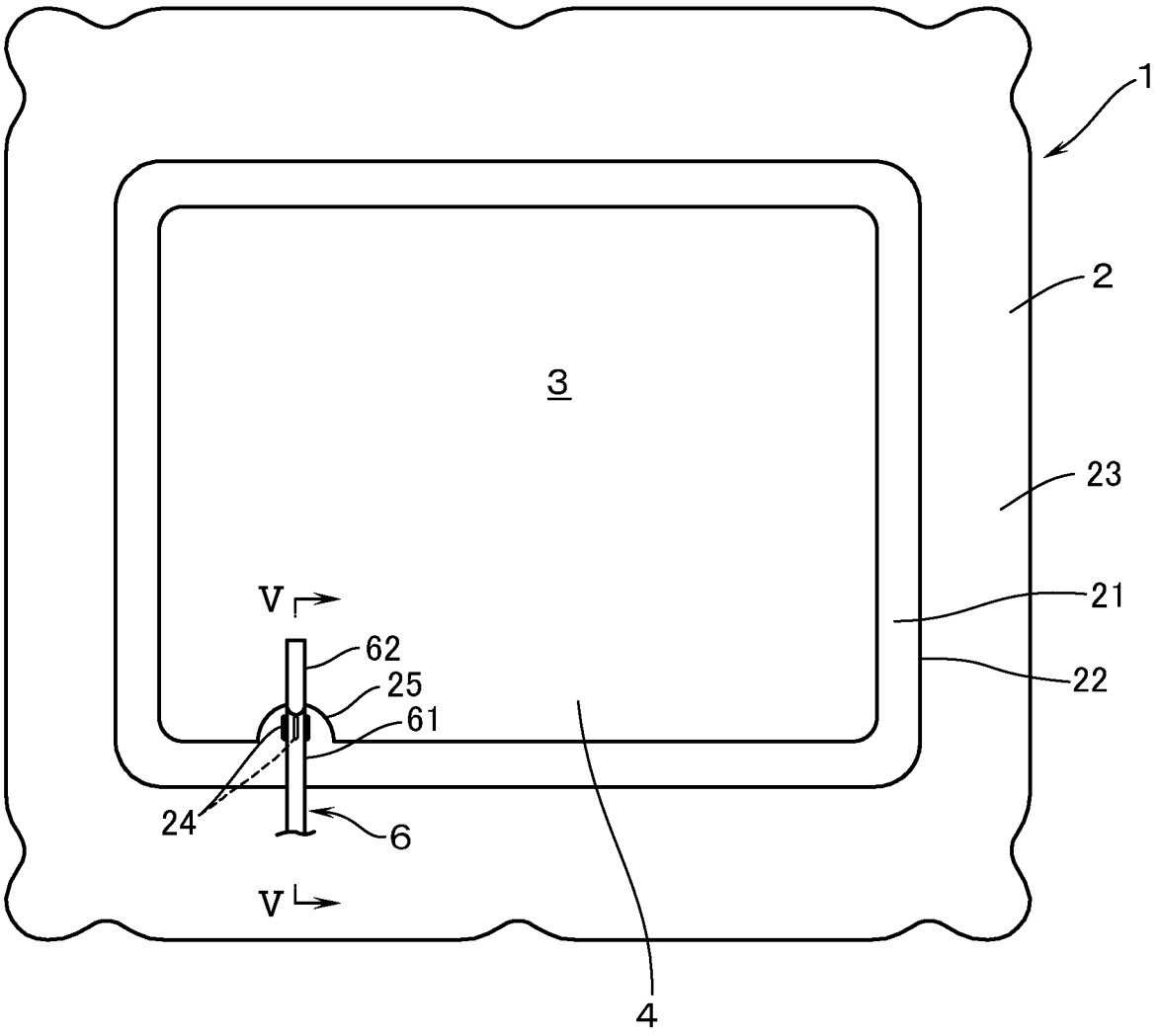
FIG. 4 is a plan view showing the combustion plate part of a burner according to a second embodiment of this invention.
Figure 5:
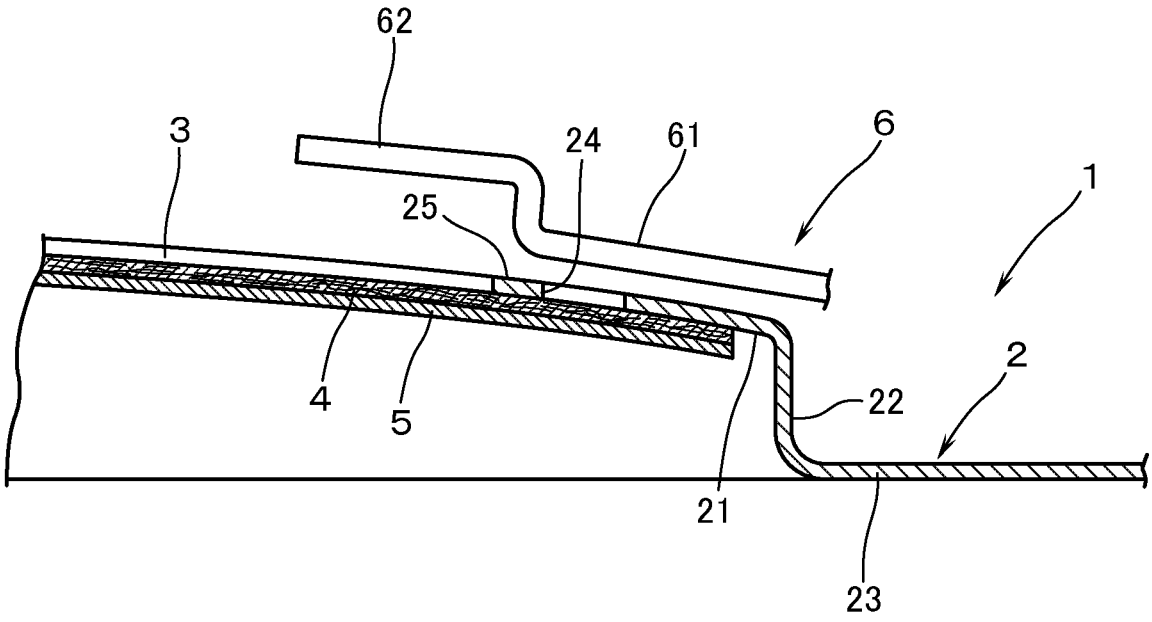
FIG. 5 is a sectional view cut along the line V-V in FIG. 4.

Description will now be made of a second embodiment with reference to FIGS. 4 and 5. In the above-mentioned first embodiment, the flame holes 24 are formed in that portion of the opening peripheral part 21 of the burner frame 2 which is linearly extended. In the second embodiment, on the other hand, a protruded part 25 which protrudes into the opening 3 is provided in a portion of the opening peripheral part 21 so that the flame holes 24 are formed in this protruded part 25. Then, the flame rod 6 is disposed so as to lie opposite to the protruded part 25 that is the portion in which the flame holes 24 are formed. The flame rod 6 is provided with: a main body portion 61 which lies opposite to the protruded part 25; and an extension portion 62 which is upwardly offset from the main body portion 61 so as to extend inward of the opening 3. Similar operation and effect can be obtained in the arrangement according to the second embodiment as in the first embodiment.

Figure 6:
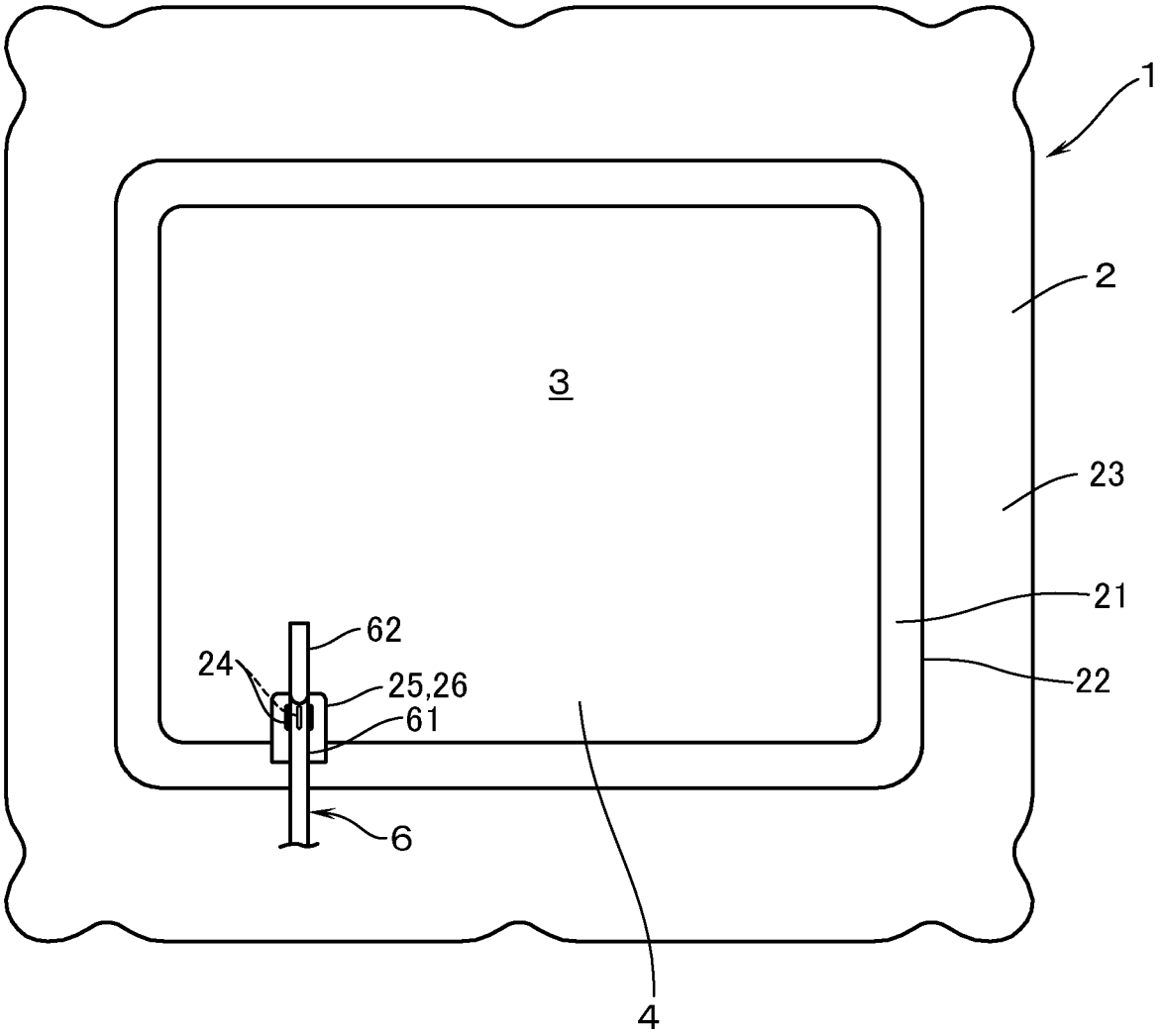
FIG. 6 is a plan view showing the combustion plate part of a burner according to a third embodiment of this invention.

By the way, in the second embodiment, the protruded part 25 is integrally formed in the burner frame 2. In a third embodiment as shown in FIG. 6, the protruded part 25 may be constituted by separate parts 26 that are separate from the burner frame 2 but which is attached to the burner frame 2. It is to be noted that the protruded part 25 will reach a considerably elevated temperature because it is protruded into the opening 3. In the arrangement of the second embodiment, it is necessary to make the entire burner frame 2 of a material higher in heat resistivity in order to secure heat resistivity of the protruded part 25. This arrangement results in higher costs. On the other hand, in the arrangement according to the third embodiment, only the separate part 26 that constitutes the protruded part 25 need be formed of a material higher in heat resistivity. This arrangement can therefore contribute to reduction in cost.

Descriptions have so far been made of embodiments of this invention with reference to the drawings. However, this invention shall not be limited to the above. For example, the flame rod 6 may be one having no extension portion 62 of the above-mentioned embodiment. In addition, in the above-mentioned embodiments, the combustion plate 1 is arranged to look upward so that the air-fuel mixture can be ejected upward. This invention can similarly be applicable to a burner in which the combustion plate is arranged to look downward or look sideways.

REFERENCE SIGNS LIST

| | | | |
|---|---|---|---|
| 1 | combustion plate part | 2 | burner frame |
| 24 | flame holes | 25 | protruded part |
| 26 | separate part | 3 | opening |
| 4 | metal-fiber knit (metal knit formed of heat resistant metal fiber) | | |
| 5 | distribution plate | 51 | distribution hole |
| 6 | flame rod | 61 | main body portion |
| 62 | extension portion | | |

The invention claimed is:

1. A burner comprising:

a combustion plate part through which air-fuel mixture is ejected; and a flame rod which lies opposite to a portion of the combustion plate part, wherein the combustion plate part is constituted by: a burner frame in a shape of a picture frame; a metal-fiber knit which covers an opening enclosed by the burner frame; and a distribution plate which has formed therein a multiplicity of distribution holes and which sandwiches the metal-fiber knit between the burner frame and the distribution plate so that the air-fuel mixture is ejected from the opening through the distribution holes and the metal-fiber knit, wherein flame holes for ejecting the air-fuel mixture are formed in a portion of the burner frame, and wherein the flame rod is disposed so as to lie opposite to that portion of the burner frame which has formed therein the flame holes.

2. The burner according to claim 1, wherein the burner frame has partly formed therein a protruded part which protrudes into the opening, and wherein the flame holes are formed in the protruded part.

3. The burner according to claim 2, wherein the protruded part is constituted by a separate part which is independent of, but which is attached to, the burner frame.

4. The burner according to claim 1, wherein the flame rod is provided with: a main body portion lying opposite to that portion of the burner frame which has formed therein the flame holes; and an extension portion which extends from the main body portion inward of the opening, and wherein the extension portion is further away from the combustion plate part than is the main body portion.

* * * * *